US012571568B2

(12) United States Patent
Gorman et al.

(10) Patent No.: US 12,571,568 B2
(45) Date of Patent: Mar. 10, 2026

(54) REFRIGERANT CIRCUIT EXPANSION VALVE CONTROL

(71) Applicant: TRANE INTERNATIONAL INC., Davidson, NC (US)

(72) Inventors: Daniel Gorman, La Crosse, WI (US); Daryl Keys, La Crosse, WI (US); Benjamin Elias Dingel, La Crosse, WI (US)

(73) Assignee: TRANE INTERNATIONAL INC., Davidson, NC (US)

( * ) Notice: Subject to any disclaimer, the term of this patent is extended or adjusted under 35 U.S.C. 154(b) by 134 days.

(21) Appl. No.: 18/332,511

(22) Filed: Jun. 9, 2023

(65) Prior Publication Data

US 2024/0410630 A1 Dec. 12, 2024

(51) Int. Cl.
*F25B 41/31* (2021.01)

(52) U.S. Cl.
CPC ..... *F25B 41/31* (2021.01); *F25B 2600/2513* (2013.01); *F25B 2700/21152* (2013.01); *F25B 2700/21161* (2013.01); *F25B 2700/21174* (2013.01)

(58) Field of Classification Search
CPC ..... F25B 41/31; F25B 2600/2513; F25B 2700/21152; F25B 2700/21161; F25B 2700/21174
See application file for complete search history.

(56) References Cited

U.S. PATENT DOCUMENTS

| | | | | |
|---|---|---|---|---|
| 10,955,179 | B2 | 3/2021 | Kulankara | |
| 2015/0059373 | A1 | 3/2015 | Maiello et al. | |
| 2019/0203999 | A1* | 7/2019 | Kulankara | F25B 45/00 |
| 2020/0408450 | A1* | 12/2020 | Tisserand | F25B 49/022 |
| 2022/0170679 | A1 | 6/2022 | Fujimoto et al. | |

FOREIGN PATENT DOCUMENTS

CN 115972855 A 4/2023

OTHER PUBLICATIONS

Chongxiang, Electronic Expansion Valve Control System and Vehicle, Apr. 8, 2023, CN115972855A, Whole Document (Year: 2023).*
Extended European Search Report, European Patent Application No. 24180778.3, Oct. 14, 2024 (9 pages).

* cited by examiner

*Primary Examiner* — Larry L Furdge
(74) *Attorney, Agent, or Firm* — HSML P.C.

(57) ABSTRACT

A method is for operating an expansion valve in a refrigerant circuit that includes a compressor, a condenser, the expansion valve, an evaporator, and a working fluid. The method includes determining a modified subcooling value based on a condenser working fluid discharge temperature, a condenser discharge subcooling setpoint, and one or more of a compressor discharge temperature and an evaporator approach temperature. The method also includes adjusting the expansion valve according to the modified subcooling value. A refrigerant circuit for a heating, ventilation, air conditioning, and refrigeration system includes a controller configured to operate the expansion valve according to a modified subcooling value.

20 Claims, 4 Drawing Sheets

REFRIGERANT CIRCUIT EXPANSION VALVE CONTROL

FIELD

This disclosure relates to refrigerant circuits for a heating, ventilation, air conditioning, and refrigeration ("HVACR") systems. More particularly, this disclosure relates to controlling of an expansion valve in such refrigerant circuits.

BACKGROUND

Heating, ventilation, air conditioning, and refrigeration (HVACR) systems are generally used to heat, cool, and/or ventilate an enclosed space (e.g., an interior space of a commercial building or a residential building, an interior space of a refrigerated transport unit, or the like). A HVACR system may include a refrigerant circuit for providing cooled or heated air to the area. The refrigerant circuit utilizes a working fluid to cool or heat the air directly or indirectly. Typically, a refrigerant circuit includes a compressor for compressing the working fluid and an expansion valve for expanding the compressed working fluid.

SUMMARY

In an embodiment, a method is directed to operating an expansion valve in a refrigerant circuit. The refrigerant circuit includes a compressor, a condenser, the expansion valve, and an evaporator that are fluidly connected, the refrigerant circuit containing a working fluid. The method includes determining a modified subcooling value based on a condenser working fluid discharge temperature, a condenser discharge subcooling setpoint, and one or more of a compressor discharge temperature and an evaporator approach temperature. The method also includes adjusting the expansion valve according to the modified subcooling value.

In an embodiment, the determination of the modified subcooling value includes modifying a subcooling value to incorporate an offset based on the one or more of the compressor discharge temperature and the evaporator approach temperature.

In an embodiment, the modifying of the subcooling value to incorporate the offset includes applying the offset to at least one of a subcooling of the working fluid discharged from the condenser, the condenser discharge subcooling setpoint, a condenser discharge working fluid saturation temperature, a pressure of the working fluid discharged from the condenser, and the condenser working fluid discharge temperature.

In an embodiment, the offset is configured to decrease a working fluid liquid level in the evaporator and increase a working fluid liquid level in the condenser.

In an embodiment, the modified subcooling value is based on the condenser working fluid discharge temperature, the condenser discharge subcooling setpoint, the compressor discharge temperature, and a compressor discharge superheat setpoint.

In an embodiment, the modified subcooling value is based on the condenser discharge subcooling setpoint, a compressor discharge superheat setpoint, a subcooling of the working fluid discharged from the condenser, and a superheat of the working fluid discharged from the compressor.

In an embodiment, the determining of the modified subcooling value includes determining a subcooling value based on the condenser working fluid discharge temperature and the condenser discharge subcooling setpoint.

In an embodiment, the determining of the subcooling value includes determining a subcooling of the working fluid discharged from condenser. The subcooling is a difference between the condenser working fluid discharge temperature and a saturation temperature of the working fluid discharged from the condenser.

In an embodiment, the adjusting of the expansion valve according to the modified subcooling value changes a position of the expansion valve in proportion to the modified subcooling value.

In an embodiment, the modified subcooling value is determined based on the condenser working fluid discharge temperature, the condenser discharge subcooling setpoint, and the evaporator approach temperature.

In an embodiment, the modified subcooling value is determined based on the condenser working fluid discharge temperature, the condenser discharge subcooling setpoint, and a change in the evaporator approach temperature.

In an embodiment, the method includes detecting, with a first temperature sensor, the condenser working fluid discharge temperature and detecting, with a second temperature sensor, the compressor discharge temperature or an evaporator working fluid discharge temperature. In an embodiment, a refrigerant circuit is for a heating, ventilation, air conditioning, and refrigeration system. The refrigerant circuit includes a compressor to compress a working fluid, a condenser to condense the working fluid compressed by the compressor, an expansion valve to expand the working fluid condensed by the condenser, an evaporator to evaporate the working fluid expanded by the expansion valve, and a controller for the refrigerant circuit. The controller is configured to determine a modified subcooling value based on a condenser working fluid discharge temperature, a condenser discharge subcooling setpoint, and one or more of a compressor discharge temperature and an evaporator approach temperature. The controller is also configured to adjust the expansion valve according to the modified subcooling value.

In an embodiment, the controller is configured incorporate an offset into a subcooling value, the offset being based on the one or more of the compressor discharge temperature and the evaporator approach temperature, in order to determine the modified subcooling value.

In an embodiment, the offset is configured to decrease a working fluid liquid level in the evaporator and increase a working fluid liquid level in the condenser.

In an embodiment, the modified subcooling value is determined based on the condenser working fluid discharge temperature, the condenser discharge subcooling setpoint, the compressor discharge temperature, and a compressor discharge superheat setpoint.

In an embodiment, the modified subcooling value is determined based on the condenser discharge subcooling setpoint, the condenser discharge subcooling setpoint, a subcooling of the working fluid discharged from the condenser, and a superheat of the working fluid discharged from the compressor.

In an embodiment, the controller being configured to determine the modified subcooling value includes the controller determining a subcooling value based on the condenser working fluid discharge temperature the condenser discharge subcooling setpoint.

In an embodiment, the modified subcooling value is determined based on the condenser working fluid discharge temperature, the condenser discharge subcooling setpoint, and the evaporator approach temperature.

In an embodiment, the refrigerant circuit includes a first temperature sensor and a second temperature sensor. The controller is configured to detect the condenser working fluid discharge temperature using the first temperature sensor. The controller is configured to detect the compressor working fluid discharge temperature or an evaporator working fluid discharge temperature with the second temperature sensor.

BRIEF DESCRIPTION OF DRAWINGS

Like numbers represent like features.

DETAILED DESCRIPTION

A heating, ventilation, air conditioning, and refrigeration ("HVACR") system is generally configured to heat and/or cool an enclosed space (e.g., an interior space of a commercial or residential building, an interior space of a refrigerated transport unit, or the like). The HVACR system includes a refrigerant circuit includes a working fluid (e.g., a refrigerant, a refrigerant mixture, or the like) that circulates through the refrigerant circuit.

The refrigerant circuit includes a compressor, a condenser, an expansion valve, and an evaporator. Gaseous working fluid is condensed with the condenser using a first process fluid (e.g., air, water and/or glycol, an intermediate liquid, or the like). Liquid working fluid is evaporated within the evaporator to cool a second process fluid (e.g., air, water and/or glycol, and intermediate liquid, or the like). Subcooling of the working fluid may be used for controlling the expansion valve in the refrigerant circuit to efficiently operate the condenser. During operation of the refrigerant circuit using the subcooling control, an amount/level of liquid working fluid within the evaporator may increase. For example, operating of the expansion valve using subcooling control (e.g., having a relatively lower subcooling setpoint) may change the distribution of refrigerant in the refrigerant circuit can cause the increase in the amount/level of liquid working fluid in the evaporator. For example, an increase in flowrate of a process fluid through the condenser (e.g., an increased condenser fan speed, condenser pump speed, or the like) can cause a decrease in an amount/level of liquid working fluid the condenser, which can increase the amount/level of liquid working fluid in the evaporator. The liquid working fluid in the evaporator may reach a level that causes liquid carryover into the compressor which can damage and/or destroy the compressor.

Embodiments described herein include HVACR systems, refrigerant circuits, and methods directed to subcooled controlled of an expansion valve that help prevent/minimize liquid carryover. The HVACR systems, refrigerant circuits, and method can provide efficient subcooled-based controlling of the expansion valve while also preventing/minimizing liquid carryover into the compressor.

Figure 1:
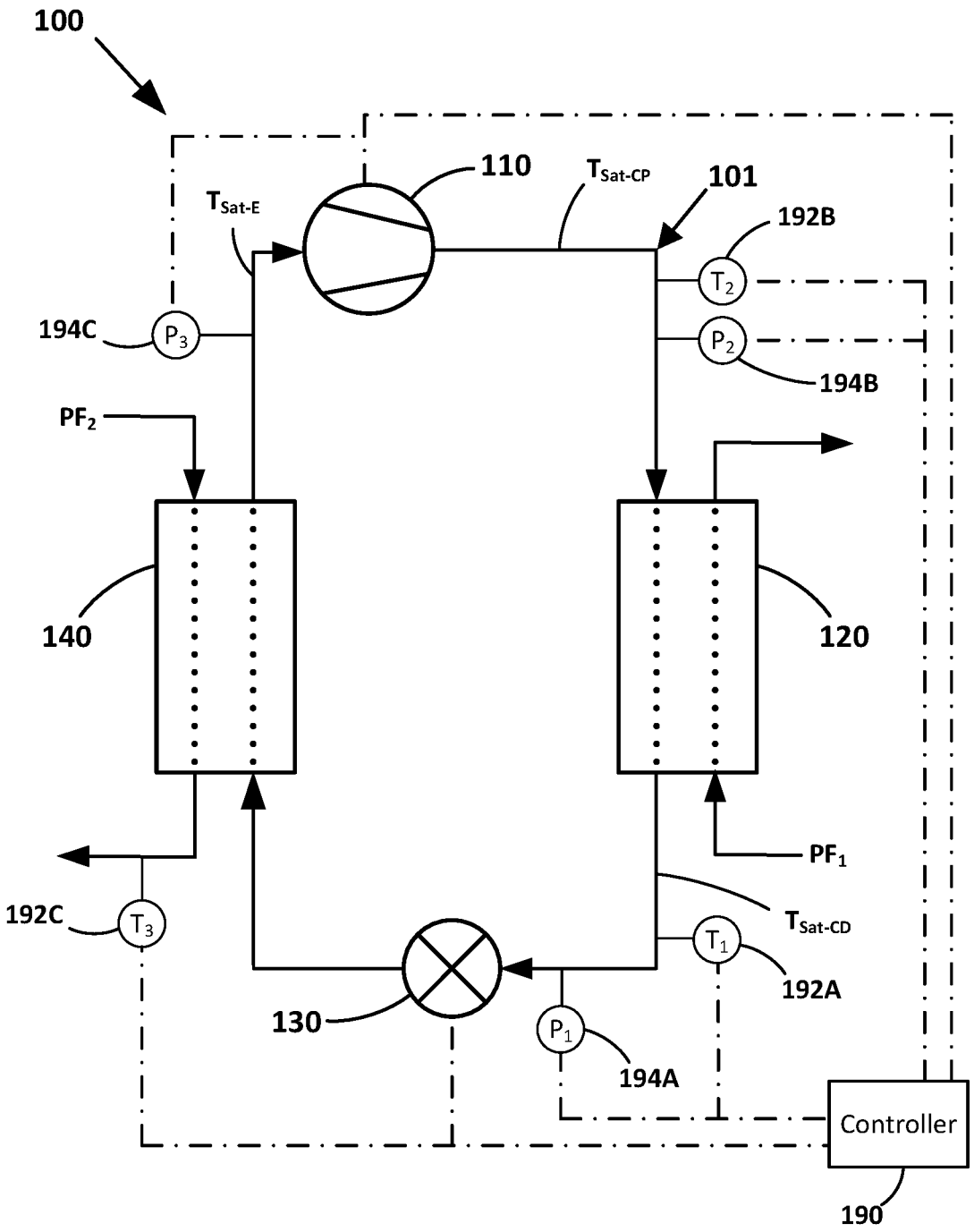
FIG. 1 is a schematic diagram of an embodiment of a refrigerant circuit of a heating, ventilation, air conditioning, and refrigeration system.

FIG. 1 is a schematic diagram of a refrigerant circuit 101 of a HVACR system 100, according to an embodiment. The refrigerant circuit 101 includes a compressor 110, a condenser 120, an expansion valve 130, and an evaporator 140. In an embodiment, the refrigerant circuit 101 can be modified to include additional components. For example, the refrigerant circuit 101 in an embodiment may include a lubricant separator, an economizer heat exchanger, one or more flow control devices, a receiver tank, a dryer, a suction-liquid heat exchanger, or the like.

Dotted lines are provided in FIG. 1 to indicate fluid flows through some components (e.g., condenser 120, evaporator 140) for clarity, and should be understood as not specifying a specific route within each component. The components of the refrigerant circuit 101 are fluidly connected. As shown in FIG. 1, the compressor 110, condenser 120, expansion valve 130, and the evaporator 140 are fluidly connected (e.g., in series). The refrigerant circuit 101 can be configured as a cooling system (e.g., a fluid chiller of an HVACR system, an air conditioning system, or the like) that can be operated in a cooling mode, and/or the refrigerant circuit 101 can be configured to operate as a heat pump system that can run in a cooling mode and a heating mode.

The refrigerant circuit 101 applies known principles of gas compression, gas expansion, and heat transfer. The refrigerant circuit 101 can be configured to cool a process fluid (e.g., water, air, or the like). In an embodiment, the refrigerant circuit 101 is a chiller that cools a process fluid (i.e., second process fluid $PF_2$) that is a chiller liquid such as water, a water mixture, or the like. In an embodiment, the refrigerant circuit 101 may represent an air conditioner and/or a heat pump that cools and/or heats a process fluid such as air, water, or the like.

The refrigerant circuit 101 contains a working fluid that flows through the refrigerant circuit 101. The working fluid contains a refrigerant, a refrigerant mixture, or the like. It should also be appreciated that the working fluid may also contain other working fluid/refrigerant additives (e.g., lubricant(s), anti-foaming agent(s), inhibitor(s), and the like).

During the operation of the refrigerant circuit 101, the working fluid flows into the compressor 110 from the evaporator 140 in a gaseous state at a relatively lower pressure. The compressor 110 compresses the gas into a high pressure state, which also heats the gas. The type of compressor is not particularly limited. In an embodiment, the compressor 110 may be a type with a minimum discharge superheat for operating as desired. In one example, the compressor 110 can be a scroll compressor.

After being compressed, the relatively higher pressure and higher temperature (gaseous) working fluid flows from the compressor 110 to and through the condenser 120. In addition to the working fluid flowing through the condenser 120, a first process fluid $PF_1$ (e.g., external air, external water, chiller water, or the like) also separately flows through the condenser 120. The condenser 120 is a heat exchanger configured to allow heat exchange between the working fluid and the first process fluid $PF_1$ without physically mixing. The first process fluid absorbs heat from the working fluid as the first process fluid $PF_1$ flows through the condenser 120, which cools the working fluid as it flows through the condenser. In an embodiment, the condenser 120 has a working fluid volume that is equal to a working fluid volume of the evaporator 140. In one example, the working fluid volume of the condenser 120 is greater than the working fluid volume of the evaporator 140. Working fluid volume refers to the total internal volume in the heat exchanger for containing the working fluid/refrigerant flowing through the heat exchanger.

The working fluid condenses to liquid and then flows into the expansion valve 130. The expansion valve 130 allows the working fluid to expand, which converts the working fluid to a mixed vapor and liquid state. The expansion valve 130 is an electronic flow control valve that is adjustable to control the flowrate of the working fluid through the expansion valve 130 (e.g., has an opening that is adjustable to change the amount of working fluid flowing through the valve). For example, an "electronic" flow control valve is driven by an electronic motor to adjust the degree that the valve is open (e.g., to vary the flowrate of working fluid through the expansion valve 130). A "position" of the expansion valve 130 refers to the extent that valve is opened or closed. The positions of the expansion valve 130 include a first position (e.g., a 100% open position), a second position (e.g., a 100% closed position or a 0% open positon), and a plurality of intermediate positions (i.e., steps) between the first and second positions (e.g., 90% open, 80% open, 70% open, 60% open, and the like). The number of intermediate positions can be selected based on a desired sensitivity for the valve. For example, the valve may have, but is not limited to, 10*s* of positions, 100*s* of positions, 1000*s* of positions, or the like based on the desired flow control for the valve. Control of the expansion valve 130 is discussed in more detail below.

The relatively lower temperature, vapor/liquid working fluid then flows from the expansion valve 130 into the evaporator 140. A second process fluid $PF_2$ (e.g., air, water, or the like) also flows through the evaporator 140. The evaporator 140 is a heat exchanger configured to allow heat exchange between the working fluid and the second process fluid $PF_2$ without physically mixing. The evaporator 140 may be a type of heat exchanger used with subcooling controlled expansion valve. For example, the evaporator 140 may be, but is not limited to, a flooded heat exchanger, a brazed plate heat exchanger, or the like. In an embodiment, the evaporator 140 is a flooded evaporator. The working fluid absorbs heat from the second process fluid $PF_2$ as it flows through the evaporator 140, which cools the second process fluid $PF_2$ as it flows through the evaporator 140. As the working fluid absorbs heat, the working fluid evaporates to vapor. The working fluid then returns to the compressor 110 from the evaporator 140. The above-described process continues while the refrigerant circuit 101 is operated, for example, in a cooling mode.

The refrigerant circuit 101 includes a controller 190. The controller 190 controls operation of the refrigerant circuit 101 (e.g., of components of the refrigerant circuit 101). In particular, the controller 190 is configured to control operation of the expansion valve 130. Operation of the expansion valve 130 is discussed in more detail below. The controller 190 in the Figures and described below is described/shown as a single component. However, it should be appreciated that a "controller" as shown in the Figures and described herein may include multiple discrete or interconnected components that include a memory (not shown) and a processor (not shown) in an embodiment. In an embodiment, the controller 190 may be a controller of the HVACR system 100.

Figure 3:
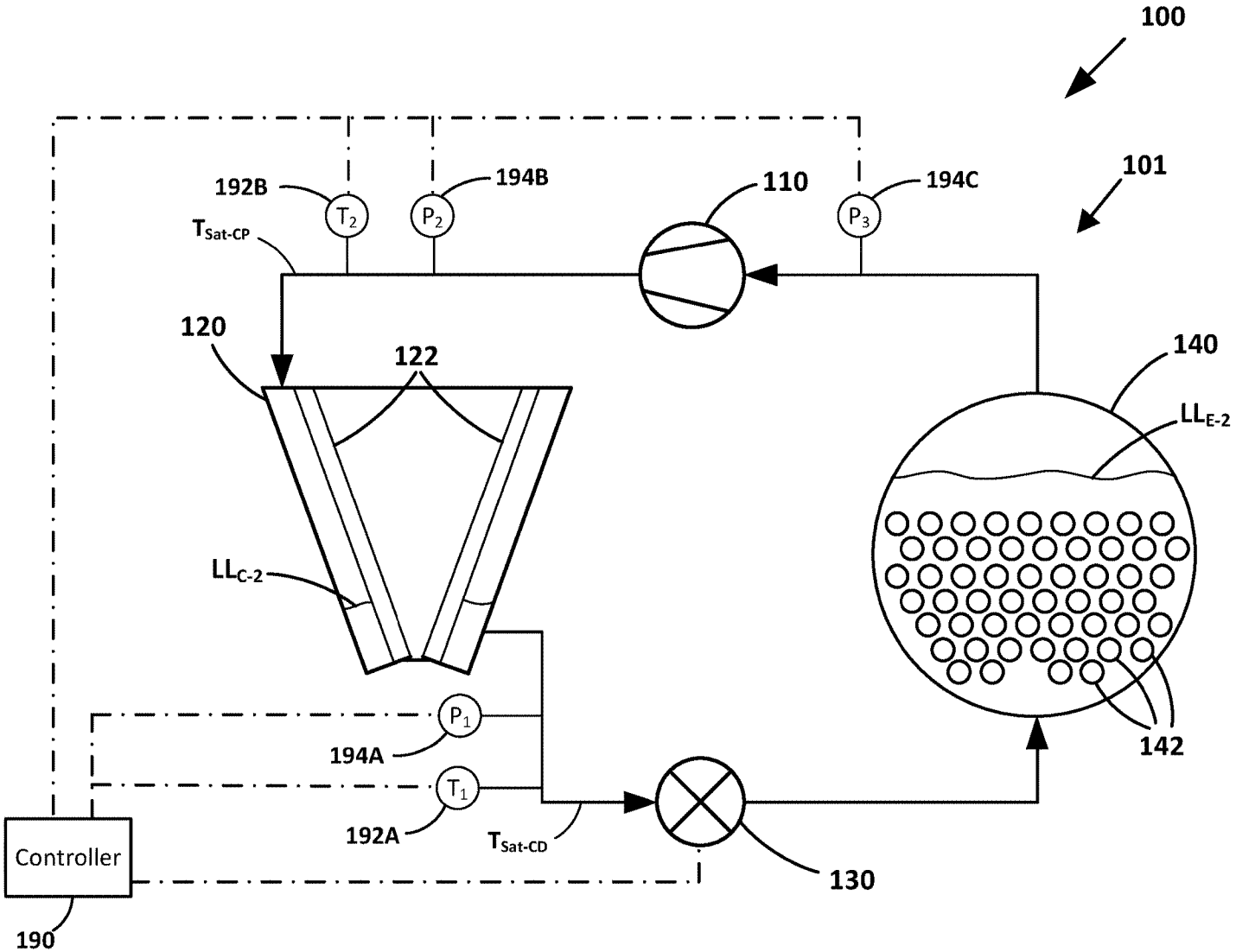
FIG. 3 is a schematic diagram of the refrigerant circuit in FIG. 1, which includes different liquid levels within the condenser and the evaporator of the refrigerant circuit, according to an embodiment.

As shown in FIG. 3, the refrigerant circuit 101 can include sensors for detecting temperature(s) and/or pressure(s) of the working fluid and/or the second process fluid $PF_2$. For example, a temperature sensor 192A is for detecting a temperature $T_1$ of the working fluid flowing from the condenser 120 to the expansion valve 130. The temperature $T_1$ is the discharge temperature of the working fluid from the condenser 130 and can also be referred to as a condenser working fluid discharge temperature. For example, a temperature sensor 192B is for detecting a temperature $T_2$ of the working fluid flowing from the compressor 110 to the condenser 120. The temperature $T_2$ is a discharge temperature of the working fluid from the compressor 110 and can also be referred to as a compressor working fluid discharge temperature or a compressor discharge temperature. For example, a temperature sensor 192C is for detecting a temperature $T_3$ of the (second) process fluid $PF_2$ discharged from the evaporator 140. The temperature $T_3$ is a discharge temperature of the process fluid $PF_2$ flowing from the evaporator 140 and can also be referred to as an evaporator process fluid discharge temperature.

For example, a pressure sensor 194A is for detecting a pressure $P_1$ of the working fluid discharged from the condenser 120. A saturation temperature $T_{Sat\text{-}CD}$ of the working fluid discharged from the condenser 120 may be detected (e.g., indirectly detected) from the pressure $P_1$ detected by the pressure sensor 194A. For example, a pressure sensor 194B is for detecting a pressure $P_2$ of the working fluid discharged from the compressor 110 (e.g., flowing from the compressor 110 to the condenser 120). A saturation temperature $T_{Sat\text{-}CP}$ of the working fluid discharged from compressor 110 may be detected (e.g., indirectly detected) from the pressure $P_2$ detected by the pressure sensor 194B. For example, a pressure sensor 194C is for detecting a pressure $P_3$ of the working fluid discharged from the evaporator 140 (e.g., flowing from the evaporator 140 to the compressor 110). A saturation temperature $T_{Sat\text{-}E}$ of the working fluid discharged from evaporator 140 may be detected (e.g., indirectly detected) from the pressure $P_3$ detected by the pressure sensor 194C.

In an embodiment, a pressure drop across the condenser 120 may be minimal (e.g., pressure $P_1$ is at or about pressure $P_2$), such that the condenser discharge saturation temperature $T_{Sat\text{-}CD}$ and compressor discharge saturation temperature $T_{Sat\text{-}CP}$ are substantially the same (e.g., $T_{Sat\text{-}CD} \approx T_{Sat\text{-}CP}$). In another embodiment, the pressure drop across the condenser 120 may be known from previous testing or computational modeling of the refrigerant circuit 101. In such embodiments, a single pressure sensor 194A, 194B may detect a pressure $P_1$, $P_2$ that is used for both the condenser discharge saturation temperature $T_{Sat\text{-}CD}$ and the compressor discharge saturation temperature $T_{Sat\text{-}CP}$.

The refrigerant circuit 102 may include other temperature/pressure sensors than those shown in FIG. 1. For example, the refrigerant circuit 102 may include temperature sensor(s) for detecting an outlet temperature of the compressor 110, detecting a working fluid inlet temperature of the evaporator 140, for detecting a process fluid inlet temperature of the evaporator 140, and the like.

It should be appreciated that the saturation temperature-pressure relationship for a working fluid (e.g., a lookup table, a formula, or the like) can be determined from previous testing, computational modeling, or like of the working fluid or a similar working fluid. The controller 190 may use the saturation temperature-pressure relationship for the working fluid (e.g., stored in a memory of the controller 190) to convert a detected pressure into the corresponding saturation temperature of the working fluid.

Dashed dotted lines are provided in the Figures to illustrate electronic communications between different features.

For example, in FIG. 1, a dashed dotted line extends from the controller 190 to temperature sensors 192A, 192B, 192C as the controller 190 receives measurements (e.g., temperature measurements) from each of the temperature sensors 192A, 192B, 192C. For example, a dashed-dotted line extends from the controller 190 to the expansion valve 130 as the controller 190 controls the expansion valve 130 (e.g., a position of the expansion valve, adjusting of the expansion valve, closing of the expansion valve). For example, a dashed-dotted line extends from the controller 190 to the compressor 110 as the controller 190 controls the compressor 110 in the illustrated embodiment (e.g., controls a speed of the compressor, controls unloading of the compressor, and the like).

Figure 2:
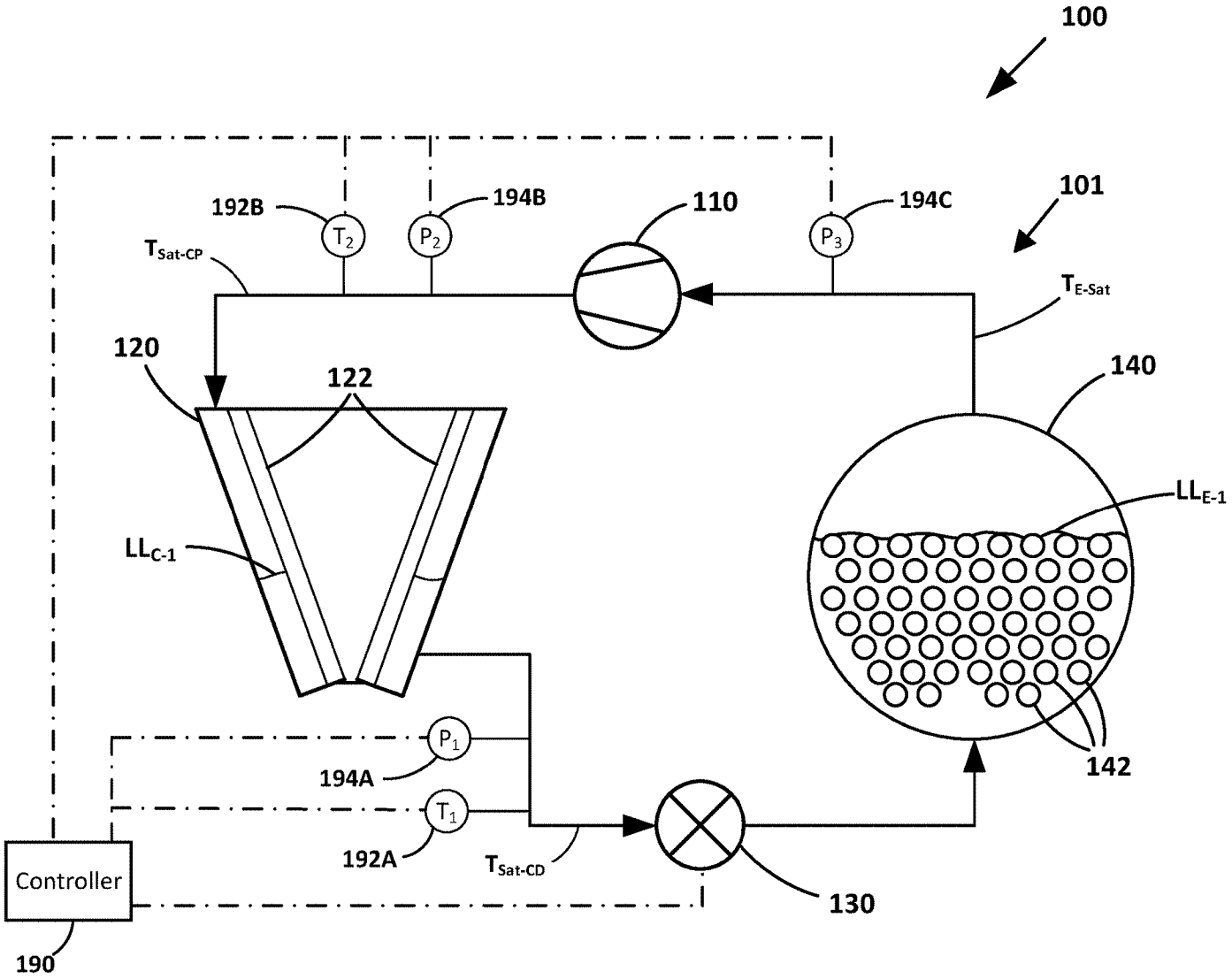
FIG. 2 is a schematic diagram of the refrigerant circuit in FIG. 1, which includes liquid levels in a condenser and in an evaporator of the refrigerant circuit, according to an embodiment.

FIGS. 2 and 3 are schematic diagrams of the refrigerant circuit 101, according to an embodiment. FIGS. 2 and 3 illustrate liquid levels of the working fluid in the condenser 120 and in the evaporator 140. In the illustrated embodiment, the first process fluid $PF_1$ (shown in FIG. 1) flows through (e.g., on the outside of) one or more condenser coil(s) 122 of the condenser 120, while the working fluid separately flows through (e.g., on the inside) of the one or more condenser coil(s) 122 of the condenser 120. In the illustrated embodiment, the second process fluid $PF_2$ (shown in FIG. 1) flows through condenser tubes 142 of the evaporator 140, while the working fluid separately flows along the outside of the condenser tubes 142 of the evaporator 140.

In FIG. 2, the working fluid liquid level $LL_{C\text{-}1}$ in the condenser 120 and the working fluid liquid level $LL_{E\text{-}1}$ are at acceptable levels. For example, the working fluid liquid level $LL_{C\text{-}1}$ in the condenser 120 is sufficiently high to ensure that little to no gaseous is in the working fluid discharged from the condenser 120 to the expansion valve 130. For example, the working fluid liquid level $LL_{C\text{-}1}$ in the condenser 120 is low enough to allow adequate space for the gaseous working fluid to flow over/through the condenser coils 122 within the condenser 120.

For example, the working fluid liquid level $LL_{E\text{-}1}$ in the evaporator 140 is sufficiently low to ensure that substantially no liquid working fluid is in the working fluid discharged from the evaporator 140 to the compressor 110. For example, the working fluid liquid level $LL_{E\text{-}1}$ in the evaporator 140 is sufficiently high to ensure the condenser tubes 142 are submerged (e.g., most to all of the condenser tubes 142 are covered, the liquid working fluid level is at or above an uppermost row of the condenser tubes 142). For example, the expansion valve 130 in FIG. 2 is controlled according to a modified subcooling value. Control of the expansion valve 130 is discussed in more detail below.

In FIG. 3, working fluid has accumulated within the evaporator 130 causing a relatively higher working fluid liquid level $LL_{E\text{-}2}$ in the evaporator 140. A relatively higher working fluid liquid level can cause carryover of liquid working fluid from the evaporator 140 into the compressor 110. For example, the working fluid flowing from the evaporator 140 into the compressor 110 can be in a mixed liquid and vapor state that contains liquid working fluid (e.g., the working fluid flowing into the compressor 110 contains a substantial amount of liquid working fluid). The working fluid liquid level $LL_{E\text{-}2}$ in the condenser can also be relatively low. For example, the low working fluid level $LL_{E\text{-}2}$ in the condenser can cause the working fluid flowing from the condenser 120 to the expansion valve 130 to contain gaseous working fluid (e.g., to contain gaseous working fluid and liquid working fluid, to contain a substantial amount of gaseous working fluid).

The expansion valve 130 in FIG. 3 is changed to operate in a charge adjustment subcooling mode. For example, the controller 190 is configured to operate the expansion valve 130 in the charge adjustment subcooling mode. In the charge adjustment subcooling mode, the expansion valve 130 is controlled according to a modified subcooling value. The controller 190 is configured to change from the subcooling mode to the charge adjustment subcooling mode based on a detected temperature in the refrigerant circuit 101. In an embodiment, the detected temperature may be the working fluid discharge temperature $T_2$ of the compressor 110. In an embodiment, the detected temperature may be the process fluid discharge temperature $T_3$ of the evaporator 140.

In an embodiment, the expansion valve 130 is controlled according to a subcooling value in FIG. 2. The expansion valve 130 in FIG. 3 can then be controlled according to a modified subcooling value to prevent the working fluid liquid level in the evaporator 140 from reaching a level that results in carryover of liquid working fluid into the compressor 110. In an embodiment, the expansion valve 130 may be constantly controlled according to a modified subcooling value that would prevent the working fluid liquid level in the evaporator 140 from reaching the relatively high working fluid liquid level $LL_{E\text{-}2}$ shown in FIG. 3. Control of the expansion valve 130 is discussed in more detail below.

Figure 4:
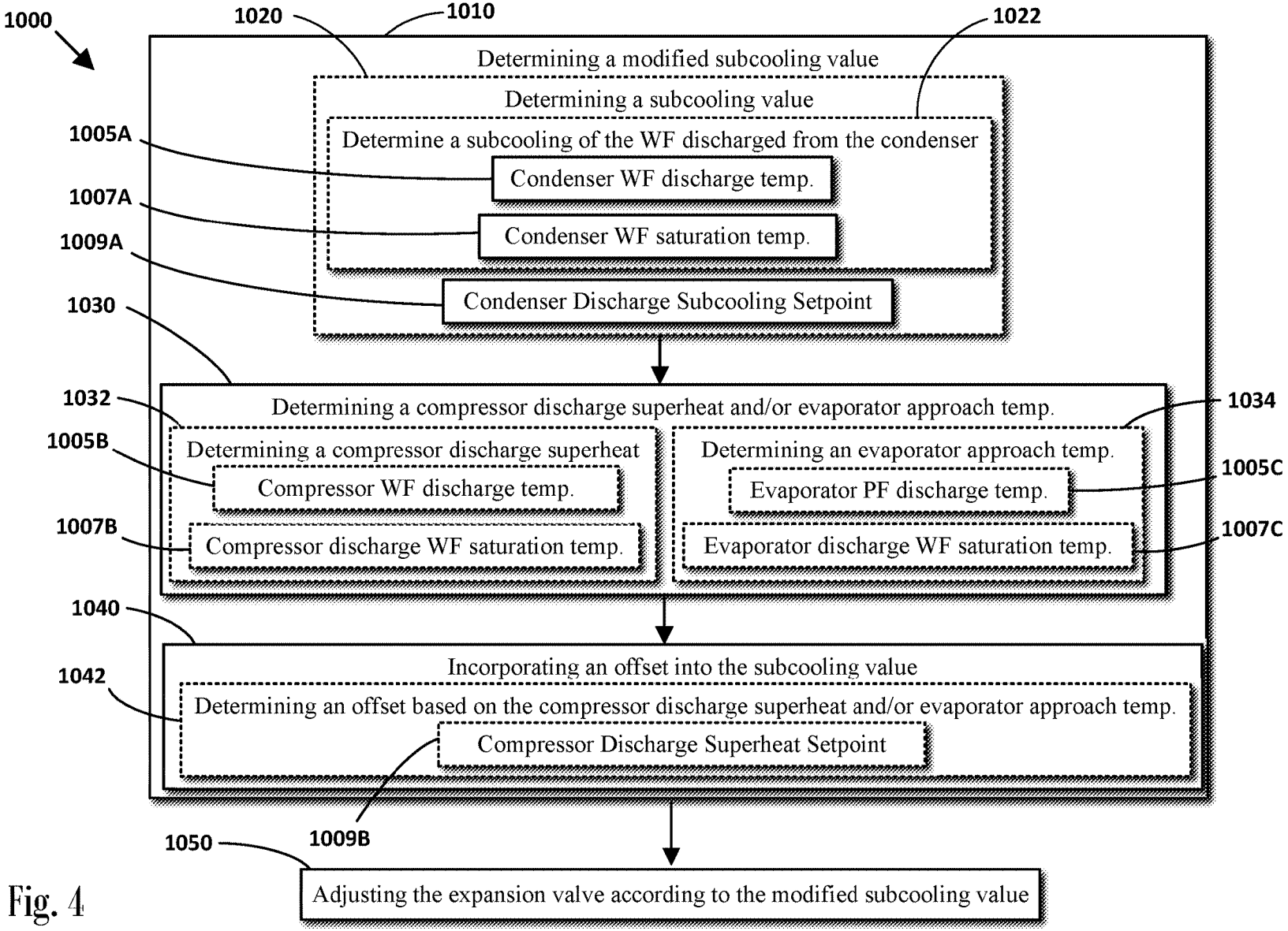
FIG. 4 is a block flow diagram of an embodiment of a method of controlling an expansion valve in a refrigerant circuit.

FIG. 4 is a block flow diagram of a method 1000 of operating an expansion valve in a refrigerant circuit. The refrigerant circuit includes a compressor (e.g., compressor 110), a condenser (e.g., condenser 120), the expansion valve, and an evaporator (e.g., evaporator 140) which are fluidly connected (e.g., in series). In an embodiment, the method 1000 may be used for operating the expansion valve 130 in the refrigerant circuit 101 in FIGS. 1-3. For example, the controller 190 of the refrigerant circuit 101 may employ the method 1000 to operate the expansion valve 130. In FIG. 4, the term working fluid is abbreviated as "WF" and the term process fluid is appreciated as "PF". As shown in FIG. 4, the method 1000 starts at 1010.

At 1010, a modified subcooling value is determined. The modified subcooling value is determined based on a condenser working fluid discharge temperature 1005A (e.g., condenser working fluid discharge temperature $T_1$), a condenser discharge subcooling setpoint 1009A, and one or more of a compressor working fluid discharge temperature 1005B (e.g., compressor working fluid discharge temperature $T_2$) and an evaporator approach temperature. For example, the modified subcooling value may be based on a condenser working fluid discharge temperature 1005A (e.g., condenser working fluid discharge temperature $T_1$), a condenser discharge subcooling setpoint 1009A, and one or more of compressor discharge superheat and evaporator approach temperature. The condenser working fluid discharge temperature can be detected using a temperature sensor (e.g., temperature sensor 192A). The evaporator approach temperature can be detected using another temperature sensor (e.g., temperature sensor 192C) and a pressure sensor (e.g., pressure sensor 194C). As shown in FIG. 3, the determination of the modified subcooling value 1010 can include 1020, 1030, and 1040.

At 1020, a subcooling value is determined based on the condenser working fluid discharge temperature 1005A, a condenser working fluid saturation temperature 1007A (e.g., a saturation temperature of the working fluid discharged from the condenser, condenser working fluid saturation temperature $T_{Sat\text{-}CD}$), and a condenser discharge subcooling setpoint 1009A. The determining of the subcooling value 1020 can include determining a subcooling of the working fluid discharged from the condenser 1022. The subcooling at 1022 is a difference between the condenser working fluid saturation temperature 1007A and the condenser working fluid discharge temperature 1005A (e.g., subcooling=condenser working fluid saturation temperature 1007A-condenser working fluid discharge temperature 1005A). The condenser working fluid saturation temperature 1007A may be determined from a pressure (e.g., pressure $P_1$) of the working fluid in/discharged from the condenser. For example, a pressure sensor (e.g., pressure sensor 194A) of the refrigerant circuit may be used to detect the working fluid condenser pressure. For example, the compressor working fluid discharge temperature can be detected using a temperature sensor (e.g., temperature sensor 192B).

The determination of the subcooling value 1022 can include comparing the subcooling (determined at 1022) to the condenser discharge subcooling setpoint 1009A. For example, this comparison can be the difference between the subcooling and the subcooling setpoint 1009A (e.g., subcooling value=determined subcooling-subcooling setpoint 1009A). In an embodiment, the subcooling value at 1022 is the difference between the subcooling at 1022 and the subcooling setpoint 1009A. In an embodiment, the subcooling setpoint 1009A is a predetermined subcooling setpoint. For example, the predetermined subcooling setpoint 1009A can be a predetermined amount of subcooling (e.g., X degrees of subcooling). In an embodiment, a subcooling setpoint 1009A may be a variable amount/value based on a predetermined operating chart (e.g., amount/value determined using a predetermined table, predetermined operating chart, etc.). The subcooling setpoint 1009A may be selected for efficient operating of the condenser in the refrigerant circuit. The term "subcooling value" refers to a subcooling based control value used for subcooling based adjusting of the expansion valve in the refrigerant circuit. The subcooling value and the modified subcooling value may also be referred to as a subcooling control value and a modified subcooling control value, respectively. The method 1000 then proceeds from 1020 to 1030.

At 1030, the compressor discharge superheat is determined 1032 and/or the evaporator approach temperature is determined 1032. In an embodiment, 1030 includes determining the compressor discharge superheat at 1032. In such an embodiment, the modified subcooling value at 1010 is determined based on the condenser working fluid discharge temperature 1005A, the condenser discharge subcooling setpoint 1009A, and a compressor working fluid discharge temperature 1005B. For example, the modified subcooling value at 1010 is based on the condenser working fluid discharge temperature 1005A, a condenser discharge subcooling setpoint 1009A, and the compressor discharge superheat.

The determination of the compressor discharge superheat 1032 can include comparing a compressor discharge working fluid saturation temperature 1007B (e.g., saturation temperature $T_{Sat\text{-}CD}$) and the compressor working fluid discharge temperature 1005B. For example, the compressor discharge superheat can be a difference between the compressor discharge working fluid saturation temperature 1007B and the compressor working fluid discharge temperature 1005B (e.g., superheat=compressor discharge working fluid saturation temperature 1007B−compressor working fluid discharge temperature 1005B). The compressor discharge working fluid saturation temperature 1007B can be determined from a pressure (e.g., pressure $P_2$) of the working fluid discharged from the condenser. For example, a pressure sensor (e.g., pressure sensor 194B) of the refrigerant circuit may be used to detect the pressure of the working fluid discharged from the compressor.

In an embodiment, the pressure of the working fluid discharged from the condenser and the pressure of the working fluid discharged from the compressor are significantly different (e.g., $P_1 \neq P_2$), such that each pressure is detected individually. In another embodiment, a pressure drop from the discharge of the compressor to the discharge of the condenser may not be substantial (e.g., $P_1$ is at or about $P_2$). In an embodiment, a pressure drop from the discharge of the compressor to the discharge of the condenser may be known (e.g., based on previous testing, being a set value, being determined based on current operation of the refrigerant circuit, or the like). In such embodiments, a single pressure detection (e.g., from pressure sensor 192A or pressure sensor 192B) may be used for determining a single saturation temperature for both the condenser working fluid discharge saturation temperature 1007A and the compressor discharge working fluid saturation temperature 1007B.

In an embodiment, 1030 includes the determining of the evaporator approach temperature at 1034. In such an embodiment, the modified subcooling value at 1010 is determined based on the condenser working fluid discharge temperature 1005A, the condenser discharge subcooling setpoint 1009A, and the evaporator approach temperature. The evaporator approach temperature is determined by comparing an evaporator discharge working fluid saturation temperature 1007C (e.g., evaporator discharge working fluid saturation temperature $T_{Sat\text{-}E}$) and an evaporator process fluid discharge temperature 1005C (e.g., evaporator process fluid discharge temperature $T_3$). For example, the evaporator approach temperature can be a difference between the evaporator discharge working fluid saturation temperature 1007C and the evaporator process fluid discharge temperature 1005C (e.g., approach temperature=evaporator process fluid discharge temperature 1005C−evaporator discharge working fluid saturation temperature 1007C). The evaporator discharge working fluid saturation temperature 1007C can be determined from a pressure (e.g., pressure $P_3$) of the working fluid discharged from the evaporator. For example, a pressure sensor (e.g., pressure sensor 194C) of the refrigerant circuit may be used to detect the pressure of the working fluid discharged from the compressor. For example, a temperature sensor (e.g., temperature sensor 192C) may be used to detect the temperature of the process fluid (e.g., second process fluid $PF_2$) discharged from the evaporator.

In an embodiment, 1030 may include determining both the compressor discharge superheat at 1032 and the evaporator approach temperature at 1034. In such an embodiment, the modified subcooling value at 1010 is determined based on the condenser working fluid discharge temperature 1005A, the condenser discharge subcooling setpoint 1009A, a compressor working fluid discharge temperature 1005B, and an evaporator approach temperature. For example, the modified subcooling value at 1010 can be based on the condenser working fluid discharge temperature 1005A, a condenser discharge subcooling setpoint 1009A, the compressor discharge superheat (e.g., as determined at 1032), and the evaporator approach temperature (e.g., as determined at 1034). The method 1000 then proceeds from 1030 to 1040.

At 1040, an offset is incorporated into the subcooling value. As shown in FIG. 4, 1040 includes determining an offset based on the compressor discharge superheat and/or the evaporator approach temperature determined at 1042. The offset can be an adjustment for the subcooling control of the expansion valve based on the compressor discharge superheat and/or the evaporator approach temperature.

In an embodiment, the offset is based on the compressor discharge superheat determined at 1032 and a compressor discharge superheat setpoint 1009B. The offset can be determined based on comparing the compressor discharge superheat with a compressor discharge superheat setpoint 1009B. For example, the offset 1042 is a function of the difference between the compressor discharge superheat with the compressor discharge superheat setpoint 1009B (e.g., Offset=f (compressor discharge superheat−compressor discharge superheat setpoint 1009B)). In such an embodiment, the offset 1042 can be configured such that the absolute value of the offset 1042 increases with increasing of the difference between the compressor discharge superheat and the compressor discharge superheat setpoint 1009B.

In an embodiment, the offset is based on evaporator approach temperature determined at 1034. In one example, the offset is a function of the evaporator approach temperature (e.g., offset=f(evaporator approach temperature). The offset 1042 may be configured such that the absolute value of the offset increases with decreasing of the evaporator approach temperature. In another example, the offset is based on change in the evaporator approach temperature. The offset can be a function of the change in the evaporator approach temperature over time (e.g., =f($\Delta_t$ evaporator approach temperature). The offset can be configured to vary based on how the evaporator approach temperature has changed in a predetermined time period (e.g., change in evaporator approach temperature over previous X minutes, change in a rolling average of the evaporator approach temperature over previous X minutes, or the like). In such an embodiment, the offset 1042 can be configured such that the absolute value of the offset 1042 increases with increasing of evaporator approach temperature or increasing in the change in the evaporator approach temperature over time.

The modified subcooling value results from the incorporation of the offset into the subcooling value at 1040. The incorporation of the offset at 1040 is configured to be a modification of the subcooling control of the expansion valve. The offset/modification is configured to cause a decreasing of the working fluid liquid level in the evaporator (e.g., decrease from working fluid liquid level $LL_{C-2}$). The offset/modification can also increase the working fluid liquid level in the condenser (e.g., increase working fluid liquid level $LL_{E-2}$). This can advantageously allow for a combined efficiency-based subcooling control and level control in the evaporator.

In an embodiment, the incorporation of the offset 1040 is applying the offset to the subcooling value to result in the modified subcooling value. For example, the subcooling value 1022 and the offset at 1042 are determined separately and then combined (e.g., subcooling value at 1020+offset 1042, subcooling value at 1020−offset at 1042, subcooling value×offset 1042, or the like).

In another embodiment, the incorporation of the offset 1040 is the offset being used in the determination of the subcooling value, such that the determined subcooling value is the modified subcooling value. For example, the incorporation of the offset 1040 can be applying the offset at 1042 to one or more of the pressures/temperatures used in determining the subcooling value at 1020, such that the subcooling value determined at 1020 is the modified subcooling value. For example, the offset 1042 is applied to one or more of the condenser working fluid discharge temperature 1005A, the condenser working fluid saturation temperature 1007A, the condenser discharge subcooling setpoint 1009A, the pressure used for determining the condenser working fluid saturation temperature 1007A, or the like. The method 1000 then proceeds from 1010 to 1050.

At 1050, the expansion valve is adjusted according to the modified subcooling value determined at 1001. For example, the adjustment at 1050 may include changing the position of the expansion valve according to the modified subcooling value (e.g., changing the position of the expansion valve in proportion to the subcooling value). For example, the adjustment at 1050 adjusts the flowrate of the expansion valve according to the modified subcooling value (e.g., the flowrate through the expansion value is adjusted in proportion to the subcooling value).

The subcooling value can also be referred to as a subcooling control value, and the modified subcooling value can be referred to as a modified subcooling control value. For example, the subcooling value is based on adjusting the expansion valve to control/adjust the subcooling of the working fluid discharged from the condenser to be at the desired subcooling (e.g., to be at the condenser discharge subcooling setpoint). In an embodiment, the subcooling value at 1010 can be a base value for controlling the expansion valve when the refrigerant circuit is operating at the desired temperatures/working fluid levels. For example, the offset at 1032 may be configured to not change the subcooling value when the working fluid within the evaporator is at a desired level (e.g., at the working fluid liquid level $LL_{E-1}$). For example, the modified subcooling value can be equal to the subcooling value when the compressor discharge superheat is equal to the compressor superheat setpoint and/or the evaporator approach temperature is at or about constant.

It should be appreciated that the method 1000 in an embodiment may be modified based on the HVACR system 100 and refrigerant circuit 101 in FIGS. 1-3 and as described above. For example, the method 1000 may include detecting temperature(s) and pressure(s) of the working fluid in the refrigerant circuit 101 using temperature sensor(s) 192A, 192B, 192C and/or pressure sensors 194A, 194B.

Aspects:

Any of Aspects 1-12 may be combined with any of Aspects 13-20.

Aspect 1. A method of operating an expansion valve in a refrigerant circuit, the refrigerant circuit including a compressor, a condenser, the expansion valve, and an evaporator that are fluidly connected, the refrigerant circuit containing a working fluid, the method comprising: determining a modified subcooling value based on a condenser working fluid discharge temperature, a condenser discharge subcooling setpoint, and one or more of a compressor discharge temperature and an evaporator approach temperature; and adjusting the expansion valve according to the modified subcooling value.

Aspect 2. The method of Aspect 1, wherein the determination of the modified subcooling value includes modifying a subcooling value to incorporating an offset based on the one or more of the compressor discharge temperature and the evaporator approach temperature.

Aspect 3. The method of Aspect 2, wherein the modifying of the subcooling value to incorporate the offset includes applying the offset to at least one of a subcooling of the working fluid discharged from the condenser, the condenser discharge subcooling setpoint, a condenser discharge working fluid saturation temperature, a pressure of the working fluid discharged from the condenser, and the condenser working fluid discharge temperature.

Aspect 4. The method of any one of Aspects 2-3, wherein the offset is configured to decrease a working fluid liquid level in the evaporator and increase a working fluid liquid level in the condenser.

Aspect 5. The method of any one of Aspects 1-4, wherein the modified subcooling value is based on the condenser working fluid discharge temperature, the condenser discharge subcooling setpoint, the compressor discharge temperature, and a compressor discharge superheat setpoint.

Aspect 6. The method of any one of Aspects 1-5, wherein the modified subcooling value is based on the condenser discharge subcooling setpoint, a compressor discharge superheat setpoint, a subcooling of the working fluid discharged from the condenser, and a superheat of the working fluid discharged from the compressor.

Aspect 7. The method of any one of Aspects 5-6, wherein the determining of the modified subcooling value includes determining a subcooling value based on the condenser working fluid discharge temperature and the condenser discharge subcooling setpoint.

Aspect 8. The method of Aspect 7, wherein the determining of the subcooling value includes determining a subcooling of the working fluid discharged from condenser, the subcooling being a difference between the condenser working fluid discharge temperature and a saturation temperature of the working fluid discharged from the condenser.

Aspect 9. The method of any one of Aspects 1-8, wherein the adjusting of the expansion valve according to the modified subcooling value changes a position of the expansion valve in proportion to the modified subcooling value.

Aspect 10. The method of any one of Aspects 1-9, wherein the modified subcooling value is determined based on the condenser working fluid discharge temperature, the condenser discharge subcooling setpoint, and the evaporator approach temperature.

Aspect 11. The method of any one of Aspects 1-10, wherein the modified subcooling value is determined based on the condenser working fluid discharge temperature, the condenser discharge subcooling setpoint, and a change in the evaporator approach temperature.

Aspect 12. The method of any one of Aspects 1-11, further comprising: detecting, with a first temperature sensor, the condenser working fluid discharge temperature; and detecting, with a second temperature sensor, the compressor discharge temperature or an evaporator working fluid discharge temperature.

Aspect 13. A refrigerant circuit for a heating, ventilation, air conditioning, and refrigeration system, comprising: a compressor to compress a working fluid; a condenser to condense the working fluid compressed by the compressor; an expansion valve to expand the working fluid condensed by the condenser; an evaporator to evaporate the working fluid expanded by the expansion valve; a controller for the refrigerant circuit, the controller configured to: determine a modified subcooling value based on a condenser working fluid discharge temperature, a condenser discharge subcooling setpoint, and one or more of a compressor discharge temperature and an evaporator approach temperature; and adjust the expansion valve according to the modified subcooling value.

Aspect 14. The refrigerant circuit of Aspect 13, wherein the controller is configured incorporate an offset into a subcooling value, the offset being based on the one or more of the compressor discharge temperature and the evaporator approach temperature, in order to the determine of the modified subcooling value.

Aspect 15. The refrigerant circuit of Aspect 14, wherein the offset is configured to decrease a working fluid liquid level in the evaporator and increase a working fluid liquid level in the condenser.

Aspect 16. The refrigerant circuit of any one of Aspects 14-15, wherein the modified subcooling value is determined based on the condenser working fluid discharge temperature, the condenser discharge subcooling setpoint, the compressor discharge temperature, and a compressor discharge superheat setpoint.

Aspect 17. The refrigerant circuit of any one of Aspects 13-16, wherein the modified subcooling value is determined based on the condenser discharge subcooling setpoint, the condenser discharge subcooling setpoint, a subcooling of the working fluid discharged from the condenser, and a superheat of the working fluid discharged from the compressor.

Aspect 18. The refrigerant circuit of Aspect 16, wherein the controller being configured to determine the modified subcooling value includes the controller determining a subcooling value based on the condenser working fluid discharge temperature the condenser discharge subcooling setpoint.

Aspect 19. The refrigerant circuit of any one of Aspects 13-18, wherein the modified subcooling value is determined based on the condenser working fluid discharge temperature, the condenser discharge subcooling setpoint, and the evaporator approach temperature.

Aspect 20. The refrigerant circuit of any one of Aspects 13-19, further comprising: a first temperature sensor, the controller configured to detect the condenser working fluid discharge temperature using the first temperature sensor; and a second temperature sensor, the controller configured to detect the compressor working fluid discharge temperature or an evaporator working fluid discharge temperature with the second temperature sensor.

The terminology used herein is intended to describe particular embodiments and is not intended to be limiting. The terms "a," "an," and "the" include the plural forms as well, unless clearly indicated otherwise. The terms "comprises" and/or "comprising," when used in this Specification, specify the presence of the stated features, integers, steps, operations, elements, and/or components, but do not preclude the presence or addition of one or more other features, integers, steps, operations, elements, and/or components. In an embodiment, "connected" and "connecting" as described herein can refer to being "directly connected" and "directly connecting".

With regard to the preceding description, it is to be understood that changes may be made in detail, especially in matters of the construction materials employed and the shape, size, and arrangement of parts without departing from the scope of the present disclosure. This Specification and the embodiments described are exemplary only, with the true scope and spirit of the disclosure being indicated by the claims that follow.

What is claimed is:

1. A method of operating an expansion valve in a refrigerant circuit, the refrigerant circuit including a compressor, a condenser, the expansion valve, and an evaporator that are fluidly connected, the refrigerant circuit containing a working fluid, the method comprising:

determining a modified subcooling value based on a condenser working fluid discharge temperature, a condenser discharge subcooling setpoint, and one or more of a compressor discharge temperature and an evaporator approach temperature, wherein the modified subcooling value incorporates an offset that is based on the one or more of the compressor discharge temperature and the evaporator approach temperature; and adjusting the expansion valve according to the modified subcooling value.

2. The method of claim 1, wherein the determination of the modified subcooling value includes modifying a subcooling value to incorporate the offset that is based on the one or more of the compressor discharge temperature and the evaporator approach temperature.

3. The method of claim 2, wherein the modifying of the subcooling value to incorporate the offset includes applying the offset to at least one of a subcooling of the working fluid discharged from the condenser, the condenser discharge subcooling setpoint, a condenser discharge working fluid saturation temperature, a pressure of the working fluid discharged from the condenser, and the condenser working fluid discharge temperature.

4. The method of claim 1, wherein the offset is configured to decrease a working fluid liquid level in the evaporator and increase a working fluid liquid level in the condenser.

5. The method of claim 1, wherein the modified subcooling value is based on the condenser working fluid discharge temperature, the condenser discharge subcooling setpoint, the compressor discharge temperature, and a compressor discharge superheat setpoint.

6. The method of claim 1, wherein the modified subcooling value is based on the condenser discharge subcooling setpoint, a compressor discharge superheat setpoint, a subcooling of the working fluid discharged from the condenser, and a superheat of the working fluid discharged from the compressor.

7. The method of claim 5, wherein the determining of the modified subcooling value includes determining a subcooling value based on the condenser working fluid discharge temperature and the condenser discharge subcooling setpoint.

8. The method of claim 7, wherein the determining of the subcooling value includes determining a subcooling of the working fluid discharged from condenser, the subcooling being a difference between the condenser working fluid discharge temperature and a saturation temperature of the working fluid discharged from the condenser.

9. The method of claim 1, wherein the adjusting of the expansion valve according to the modified subcooling value changes a position of the expansion valve in proportion to the modified subcooling value.

10. The method of claim 1, wherein the modified subcooling value is determined based on the condenser working fluid discharge temperature, the condenser discharge subcooling setpoint, and the evaporator approach temperature.

11. The method of claim 1, wherein the modified subcooling value is determined based on the condenser working fluid discharge temperature, the condenser discharge subcooling setpoint, and a change in the evaporator approach temperature.

12. The method of claim 1, further comprising:

detecting, with a first temperature sensor, the condenser working fluid discharge temperature; and detecting, with a second temperature sensor, the compressor discharge temperature or an evaporator working fluid discharge temperature.

13. A refrigerant circuit for a heating, ventilation, air conditioning, and refrigeration system, comprising:

a compressor to compress a working fluid;

a condenser to condense the working fluid compressed by the compressor using a first process fluid;

an expansion valve to expand the working fluid condensed by the condenser;

an evaporator to evaporate the working fluid expanded by the expansion valve using a second process fluid;

sensors for one or more of the working fluid and the second process fluid, the sensors including at least one temperature sensor and at least one pressure sensor;

a controller for the refrigerant circuit, the controller configured to:

detect, via the at least one temperature sensor and the at least one pressure sensor, one or more temperatures of the working fluid and the second process fluid and at least one pressure of the working fluid, determine a modified subcooling value based on a condenser working fluid discharge temperature, a condenser discharge subcooling setpoint, and one or more of a compressor discharge temperature and an evaporator approach temperature, wherein the condenser working fluid discharge temperature, the condenser discharge subcooling setpoint, and the one or more of the compressor discharge temperature and the evaporator approach temperature are based on the detected one or more temperatures of the working fluid and the second process fluid and the detected at least one pressure of the working fluid, and the modified subcooling value incorporates an offset that is based on the one or more of the compressor discharge temperature and the evaporator approach temperature; and adjust the expansion valve according to the modified subcooling value.

14. The refrigerant circuit of claim 13, wherein the controller is configured to incorporate the offset into a subcooling value, the offset being based on the one or more of the compressor discharge temperature and the evaporator approach temperature, in order to determine the modified subcooling value.

15. The refrigerant circuit of claim 13, wherein the offset is configured to decrease a working fluid liquid level in the evaporator and increase a working fluid liquid level in the condenser.

16. The refrigerant circuit of claim 13, wherein the modified subcooling value is determined based on the condenser working fluid discharge temperature, the condenser discharge subcooling setpoint, the compressor discharge temperature, and a compressor discharge superheat setpoint.

17. The refrigerant circuit of claim 13, wherein the modified subcooling value is determined based on the condenser discharge subcooling setpoint, a compressor discharge superheat setpoint, a subcooling of the working fluid discharged from the condenser, and a superheat of the working fluid discharged from the compressor.

18. The refrigerant circuit of claim 16, wherein the controller being configured to determine the modified subcooling value includes the controller determining a subcooling value based on the condenser working fluid discharge temperature and the condenser discharge subcooling setpoint.

19. The refrigerant circuit of claim 13, wherein the modified subcooling value is determined based on the condenser working fluid discharge temperature, the condenser discharge subcooling setpoint, and the evaporator approach temperature.

20. The refrigerant circuit of claim 13, wherein the one or more temperature sensors include:

a first temperature sensor, the controller configured to detect the condenser working fluid discharge temperature using the first temperature sensor; and a second temperature sensor, the controller configured to detect the compressor working fluid discharge temperature or an evaporator working fluid discharge temperature with the second temperature sensor.

* * * * *